US005722534A

United States Patent [19]

Wright

[11] Patent Number: 5,722,534

[45] Date of Patent: Mar. 3, 1998

[54] POWER DISCONNECT SWITCH

[76] Inventor: Jere Wright, 7301 Lakewood Blvd., Dallas, Tex. 75214

[21] Appl. No.: 688,859

[22] Filed: Jul. 31, 1996

[51] Int. Cl.[6] ..... H01H 9/08

[52] U.S. Cl. ..... 200/305; 200/307; 200/554; 200/331

[58] Field of Search ..... 200/331, 332, 200/305, 304, 307, 554, 48 KB

[56] References Cited

U.S. PATENT DOCUMENTS

| | | | |
|---|---|---|---|
| 1,836,951 | 12/1931 | Blakeslee . | |
| 1,891,212 | 12/1932 | Blakeslee . | |
| 2,030,799 | 2/1936 | Parsons | 200/304 |
| 2,249,977 | 7/1941 | Penfold . | |
| 2,271,588 | 2/1942 | Hecht et al. . | |
| 3,171,939 | 3/1965 | Ustin | 200/554 |
| 4,115,669 | 9/1978 | Cali | 200/331 |
| 4,150,271 | 4/1979 | McMillen | 200/332 X |
| 4,160,889 | 7/1979 | Tognazzini et al. | 200/550 |

OTHER PUBLICATIONS

*Meter Devices Company, Inc.*, "Compact Meter and relay Knife Type Test Switches", Bulletin No. CS–474, 1981, OH, pp. 1–8.

*Meter Devices Company, Inc.*, "Mini Compact Meter and Relay Knife Type Test Switches", Bulletin No. MCS–1073, OH, pp.1–8.

*Avo International*, "States Terminal Blocks and Test Switches", 1994, pp. 1–51.

*Meter Devices Company, Inc.*, "Test Switches and Autoformers", 1991, OH, pp. 1–21.

*Meter Devices Company, Inc.*, "Metal Enclosures", 1995, OH, pp. 1–21.

*Primary Examiner*—Renee S. Luebke
*Attorney, Agent, or Firm*—Staas & Halsey

[57] ABSTRACT

A power disconnect switch having a generally parallelepiped base with first and second electrical conductors mounted thereon. A switch piece pivots on one of the electrical conductors to connect to the other electrical conductor. The switch piece has an insulated handle, and a projection extends from the handle. The projection has a shape which allows it to fit snugly into a holder tool, and this allows an operator to open the switch without danger of electrocution. An angled insulating plate which fits next to the parallelepiped base has a side portion which insulates the switch from adjacent switches, and a bottom portion which insulates screws in the parallelepiped base from a metal panel, shelf, or box, on which the switch may be mounted.

18 Claims, 7 Drawing Sheets

POWER DISCONNECT SWITCH

BACKGROUND OF THE INVENTION

1. Field of the Invention

The present invention relates to medium duty power disconnect switches in general, and more specifically to safer, easier to use and less expensive power disconnect switches.

2. Description of the Related Art

Medium duty power disconnect switches are used in power generation, power distribution systems and power transmission. For example, such switches may be used in power instrument transducers, control system calibration, protection metering and relays. Medium duty switches of this type are not generally used in home metering.

A power disconnect switch is adapted to carrying substantial power. Although such switches generally carry 20 amps and 440/480 volts, they may be required to carry 30 amps and 600 volts. To prevent electrocution, it is essential that the operator of such switches avoid all contact with the switch when opening or closing the switch.

There are two types of power disconnect switches, a temporary disconnect switch and a permanent disconnect switch. The two types are configured substantially differently, and it is often desired to use the permanent disconnect switch. The temporary disconnect switch has a relatively safe means for opening and closing the switch while preventing human contact therewith. However, the permanent disconnect must be opened by manually pushing a handle upwards. Many operators fear that their fingers will slip off the handle and touch a conducting portion of the switch. To avoid this problem, the temporary disconnect switch is often used where the permanent disconnect switch would be better suited.

The permanent disconnect switches are often mounted on a metal plate. The permanent disconnect switches have two conductors secured by screws going through a base of the switch. The base has holes in the bottom for access to these screws. For proper insulation, it is required that the screws either be placed a certain distance from the metal plate under the base or be insulated. It is not usually possible to provide for enough air space to separate the metal plate and the screws. The base of the permanent disconnect switch is simply not thick enough. Therefore, the insulation approach is commonly used. To insulate the screws, a tar-like potting material is inserted into the holes after the conductors are attached to the base with screws. Inserting potting material is a messy, time consuming job.

Other than the two holes provided for the conductors, there is a third hole in the permanent disconnect switch provided for attaching accessories thereto. If an accessory is attached, the third hole also must be potted. If one desires to disconnect the accessory or the conductors, the potting material must be removed. Often, a portion of the sticky potting material remains in the hole. This can complicate removal of the screws.

SUMMARY OF THE INVENTION

Accordingly, it is an object of the present invention to provide a safer means for disconnecting a medium duty power switch.

It is a further object of the present invention to provide a means for insulating screws extending through a base of a power disconnect switch which avoids potting.

These and other objects are accomplished with a power test switch operable by a holder tool. The power test switch has a generally parallelepiped base having first and second opposing ends and two holes extending therethrough, from a top to a bottom thereof with the two holes being located respectively at the first and second opposing ends of the base. The base has two sides which connect the top and bottom and which run from the first to the second opposing ends. According to the invention, the power to test switch has first and second electrical conductors mounted on top of the base with first and second mounting pieces extending respectively through the two holes in the base. According to the invention, a switch piece is provided for electrically connecting the first and second electrical conductors. The switch piece pivots on the first conductor to connect with the second conductor when parallel to the top of the base and to disconnect from the second conductor when extending away from and at an angle to the base. The switch piece has an upper portion which extends away from the base when the switch piece is parallel to the base. An insulated handle is attached to the upper portion of the switch piece for manually pivoting the switch piece. A projection is attached to and extends away from the insulated handle. The projection extends generally parallel to the base when the switch piece is parallel to the base. The projection has a substantially constant cross-sectional shape extending away from the handle so that the projection can fit snugly within the holder tool. According to the invention, an angled insulating plate fits next to the base. The insulating plate has a first plate portion and a second plate portion generally perpendicular to the first plate portion. The first plate portion fits adjacent to the bottom of the base to cover the two holes extending through the base. The second plate portion fits adjacent to one side of the base which runs from the first to the second opposing ends.

These together with other objects and advantages which will be subsequently apparent, reside in the details of the construction and operation as more fully hereinafter described and claimed, reference being had to the accompanying drawings, wherein like reference numerals refer to like parts throughout.

DETAILED DESCRIPTION OF THE PREFERRED EMBODIMENTS

Figure 1:
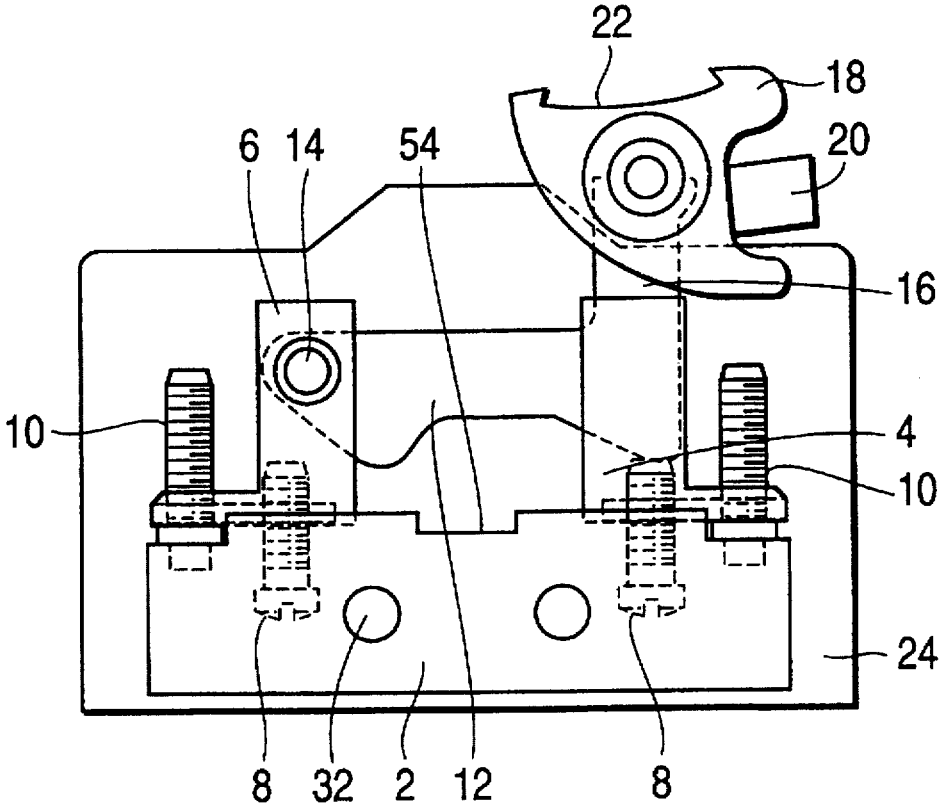
FIG. 1 is an X-ray side view of a power disconnect switch according to the present invention.

FIG. 1 is an X-ray side view of the improved power disconnect switch according to the present invention. As can be seen in FIG. 1, the switch has a base 2. Front and rear conductors 4, 6 are mounted on the base 2 with mounting pieces, mounting screws 8. Connector screws 10 also extend from the base 2. The connector screws 10 allow external electrical connection to the switch with nuts 11 (see FIG. 15). The nuts used are commonly 10-32 nuts. In the field it is common for operators to carry a special 10-32 nut driver which permits easy connection and disconnection of the 10-32 nuts. The 10-32 nut driver has an insulated handle. In FIG. 1, reference numeral 24 represents a safety barrier to be discussed further below.

Figure 2:
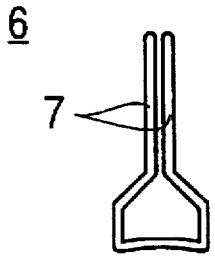
FIG. 2 is a front view of a rear conductor shown in FIG. 1.
Figure 3:
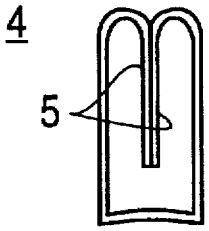
FIG. 3 is a front view of a front conductor shown in FIG. 1.

A switch piece 12 pivots in the rear conductor 6 at pivot point 14. A front view of rear conductor 6 is shown in FIG. 2. Switch piece 12 fits between hinge arms 7 of rear conductor 6. When the switch piece 12 is generally parallel to a top of the base 2, switch piece 12 makes electrical connection with the front conductor 4. A front view of front conductor 4 is shown in FIG. 3. Switch piece 12 is removably received within jaws 5 of front conductor 4.

Switch piece 12 has an upper portion 16 which extends away from the base when the switch is parallel to the base 2, and insulated handle 18 is attached to the upper portion 16 of the switch piece 12. The handle 18 has a projection 20 extending away from the handle 18. More specifically, as clearly shown in FIG. 1, the handle 18 has upper and lower extensions on either side of the projection. The upper and lower extensions define an indented surface portion therebetween from which the projection extends. Although the projection 20 is at a slight angle to the base 2, it is generally parallel to the base 2 when the switch piece 12 is parallel and connected to the front conductor 4. The projection 20 has a substantially constant cross-sectional shape extending away from the handle 18. In this manner, projection 20 can fit within a holder tool. In particular, the 10-32 nut driver may serve as the holder tool. The outer diameter of projection 20 allows it to snugly fit within the 10-32 nut driver. The projection 20 may have an angled contour similar to the 10-32 nut. Alternatively, the projection 20 can simply have a round cross-section shape. The insulated handle 18 is also provided with a recessed surface 22 at the top thereof. As shown in FIG. 1, one side of the recessed surface is defined in the upper ridge of the handle 18. A labelling tag can fit within the recessed surface 22.

Figure 4:
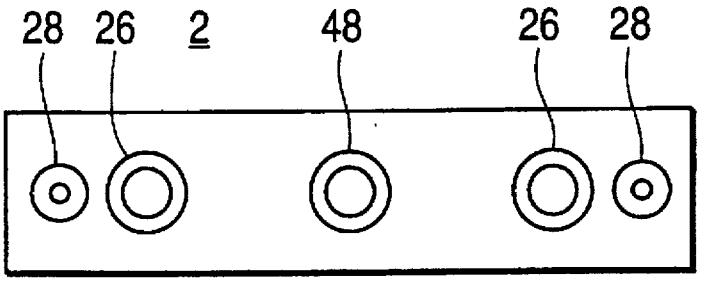
FIG. 4 is a bottom view of the switch shown in FIG. 1.

FIG. 4 is a bottom view of a base of the switch device as shown in FIG. 1. FIG. 4 shows the holes 26 provided in base 2 for mounting screws 8. FIG. 4 also shows holes 28 for connecting screws 10. As mentioned previously, holes 26, would be filled with potting material in the prior art device.

Figure 5:
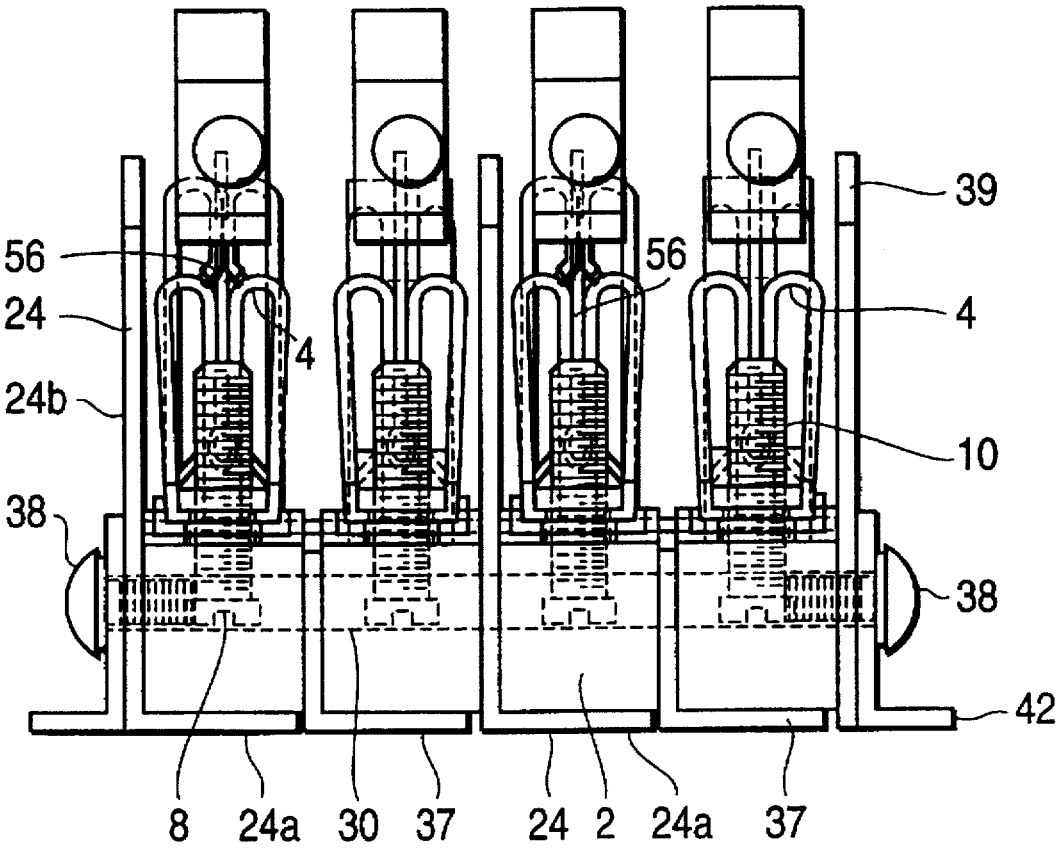
FIG. 5 is a front view of a gang of switches of the type shown in FIG. 1.
Figure 6:
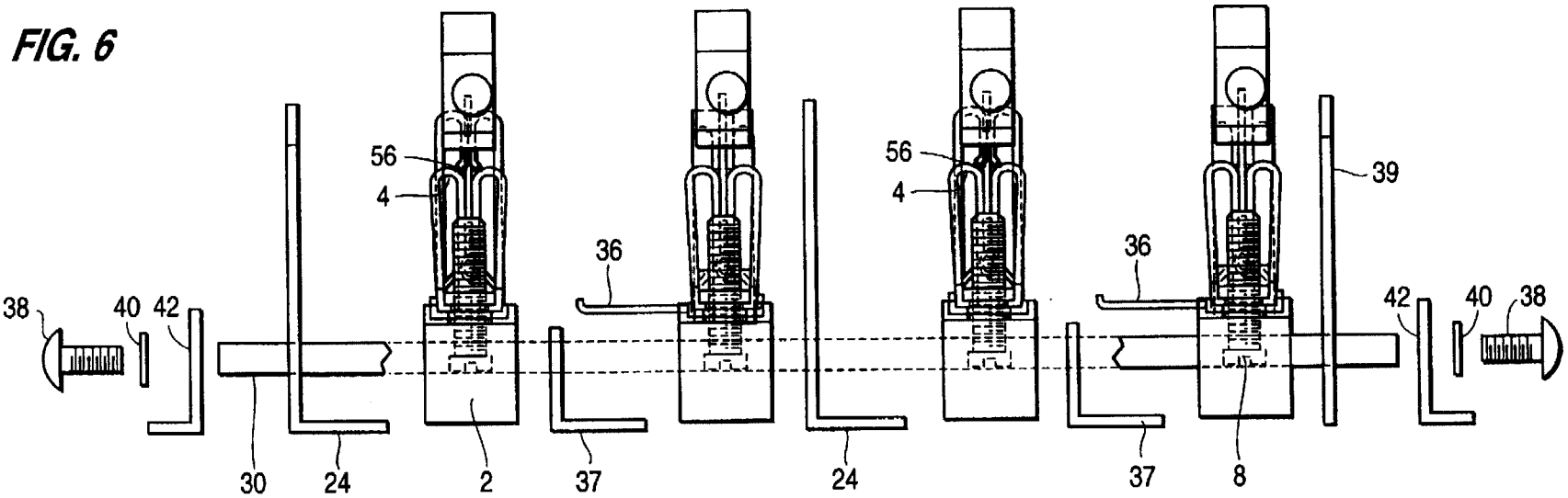
FIG. 6 is an exploded view of FIG. 5.
Figure 7:
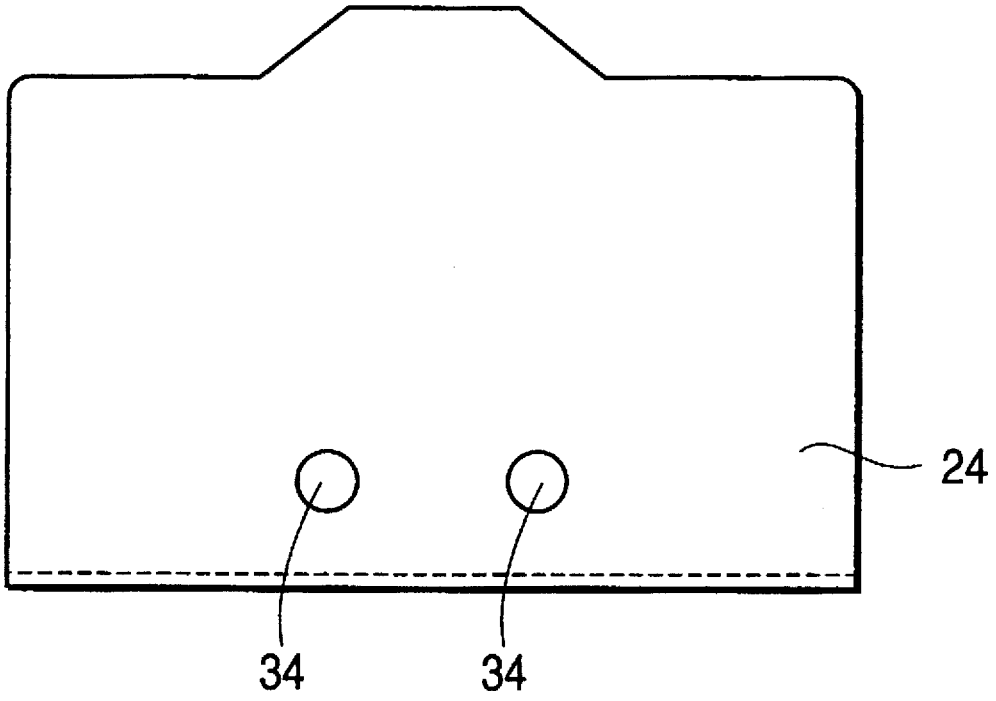
FIG. 7 is a side view of a safety barrier according to the present invention.

FIG. 5 is a side view of four switches ganged together, and FIG. 6 is an exploded side view of FIG. 5. As can be seen in FIGS. 5 and 6, a mounting rod 30 is used to connect the switches. Screws 38 secure the switches on the mounting rod 30 and a washer 40 is also provided. Referring to FIG. 1, the mounting rod 30 extends through holes 32 in the base 2. FIGS. 5 and 6 provide a better view of safety barrier 24 shown in FIG. 1. Safety barrier 24 may be required to insulate between two adjacent switches. More specifically, it can be seen from the front views of FIGS. 5 and 6 that the safety barrier 24 has a foot portion 24*a* which fits under the base 2 of the switch. Foot 24*a* is generally perpendicular to a vertical portion 24*b*. With foot 24*a* fitting under base 2, foot 24*a* serves as an insulator for screws 8, 10. In this manner, the potting material is not required. FIG. 7 is a side view of the safety barrier 24. As can be seen in FIG. 7, holes 34 are provided at places corresponding to holes 32 in base 2, for mounting rods 30.

Figure 8:
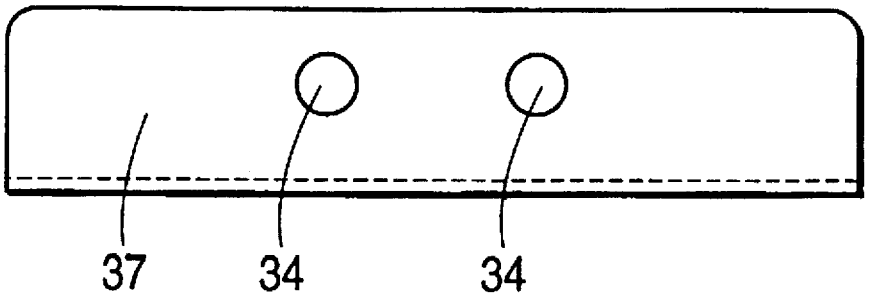
FIG. 8 is a side view of a barrier spacer according to the present invention.

As can be seen from FIGS. 5 and 6, not all of the angled spacers have the same height as safety barrier 24. More specifically, barrier spacers 37 are provided, and barrier spacers 37 have a decreased height. FIG. 8 is a side view of one barrier spacer 37. The height of barrier spacer 37 is decreased to allow for common bars 36. As we will describe more fully later, common bars 36 allow for current to be shunted from one switch to another. Like the safety barrier 24, the barrier spacer 37 has holes 34 to allow for mounting rods 30 to extend through holes 32 in base 2.

Figure 9:
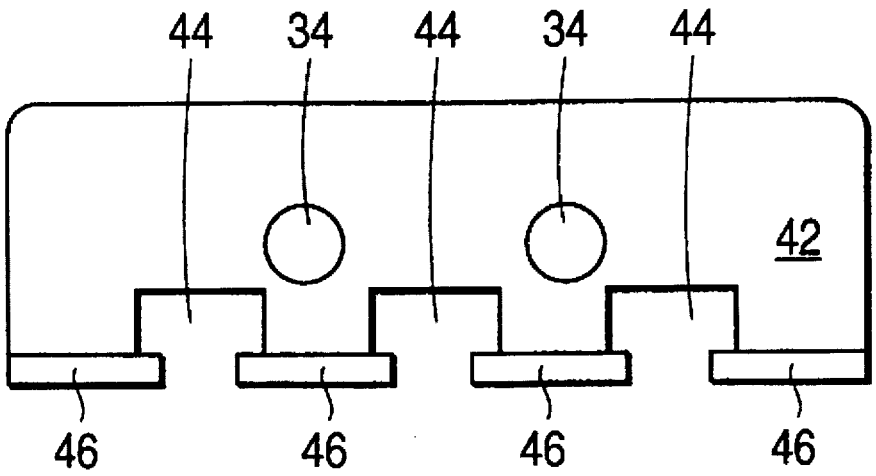
FIG. 9 is a side view of a mounting ear shown in FIGS. 5 and 6.
Figure 10:
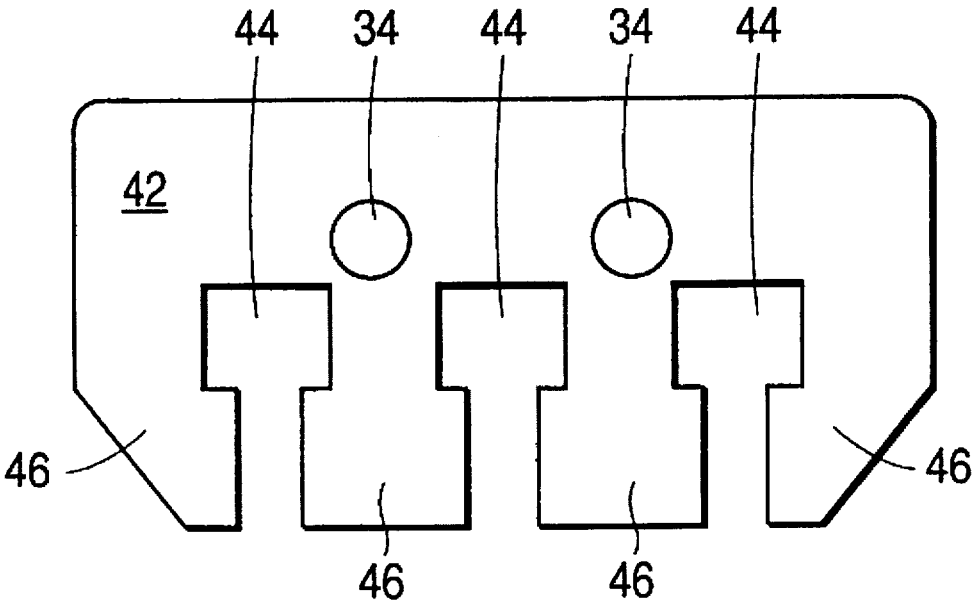
FIG. 10 is a top view of the mounting ear shown in FIGS. 5, 6 and 9, as it appears before bending.

Mounting ear 42 allows the gang of switches to be connected to a cabinet or a shelf at a site where the switches are to be installed. Referring to FIGS. 5 and 6, footless barrier 39 is used to prevent interference with mounting ear 42, when insulation under the base 2 is already provided by an adjacent barrier. The mounting ear 42 is shown more specifically in the side view of FIG. 9 and the top view of FIG. 10. The mounting ear 42 shown in FIG. 10 is a view before the mounting ear 42 is folded. Similar to the barrier spacer 37 and safety barrier 24, mounting ear 42 is provided with holes 34 for mounting rods 30. Three screws are used to secure mounting ear 42 to a cabinet or shelf. The head of the screw fits within removed areas 44 which allow the head of a screw to move vertically downward without the mounting screws contacting the vertical portion of mounting ear 42. With the mounting screws securely tightened, leaves 46 are held.

Figure 11:
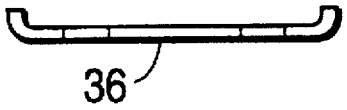
FIG. 11 is a front view of a common bar shown in FIGS. 5 and 6.
Figure 12:
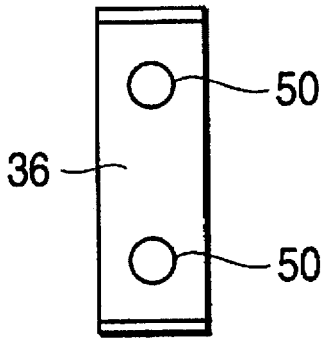
FIG. 12 is a top view of the common bar shown in FIGS. 5, 6 and 11.

FIG. 11 is a front view of the common bar 36 and FIG. 12 is a top view of the common bar 36. As can be seen from the front view of FIG. 11, the common bar 36 has raised ends. When the common bar 36 is provided to connect two switches, one of the two switches is often provided with a shorting element and the other of the two switches often provided with a test jack, both to be described in more detail later. The shorting element and test jack are mounted to the switch with screws. The screws extend through a hole 48 in the base 2 of the switch, which hole 48 is shown from the bottom in FIG. 4. Common bar 36 has holes 50 to allow the accessories (shorting element and test jack) to be connected to the base with screws extending through holes 48 in the base.

Figure 13:
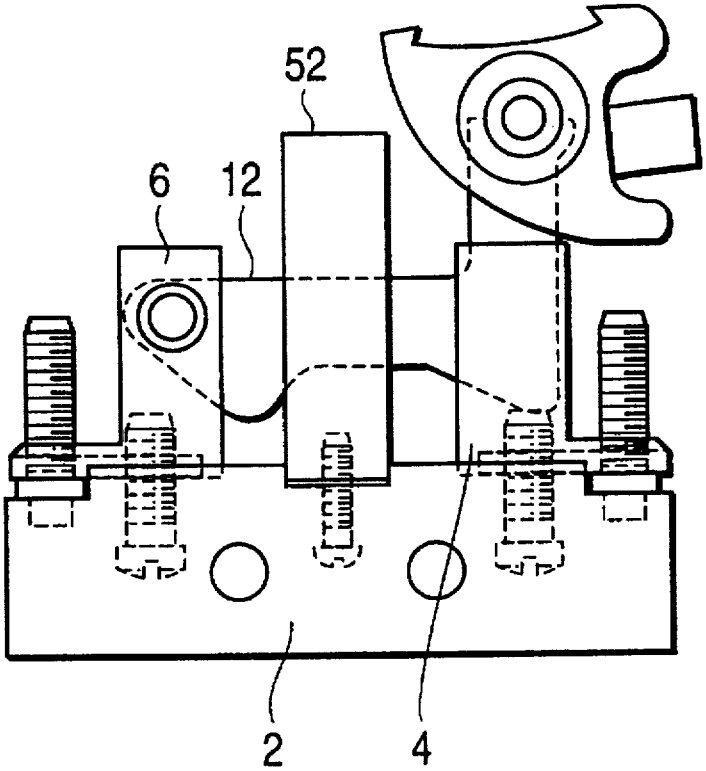
FIG. 13 is a side view of the switch shown in FIG. 1, with a shorting element mounted thereon.
Figure 14:
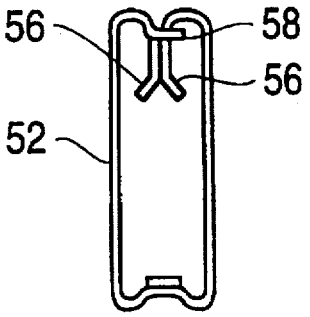
FIG. 14 is a back view of the shorting element shown in FIG. 13.

FIG. 13 is a side view of a switch with a shorting element 52 attached thereto. Referring to FIG. 1, the base 2 has an indentation 54 in the vicinity of the hole 48 (see FIG. 4) which indentation provides a space for common bars 36 and shorting element 52. A back view of the shorting element 52 is shown in FIG. 14. Shorting element 52 has angled portions 56 which separate when the top of bladed switch piece 12 is moved into contact therewith. The angled portions 56 serve to direct the blade between the two pieces of metal of shorting element 52, which are biased together. The manner in which the shorting element 52 and the front conductor 4 (see FIG. 3) receive switch piece 12 is similar, and the switch piece 12 may be configured as a double sided blade. The difference is that the shorting element 52 receives the switch piece 12 as the switch piece 12 is moving away from the base 2, and the front conductor 4 receives the switch piece 12 as the switch piece 12 is moving towards the base 2. Referring to FIGS. 5 and 6, a top end of front conductor 4 is vertically close to a bottom end of shorting element 52 as defined by angled portion 56. In this manner, when the switch piece 12 is fully inserted into front conductor 4, switch piece 12 is not engaged with shorting element 52. If the switch piece is slightly raised from front conductor 4, switch piece 12 connects with both front conductor 4 and shorting element 52.

Shorting element 52 is provided with a wrap around piece 58 shown in FIG. 14. The purpose of wrap around piece 58 is to prevent switch piece 12 from being accidentally raised too far, outside of contact with shorting element 52. When switch piece 12 is fully raised so that it contacts wrap around piece 58, switch piece 12 is not in contact with front conductor 4.

Figure 16:
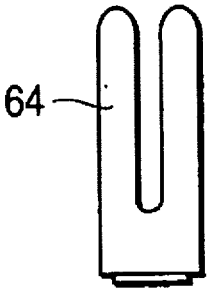
FIG. 16 is a front view of a test jack fork of the test jack assembly shown in FIG. 15.
Figure 17:
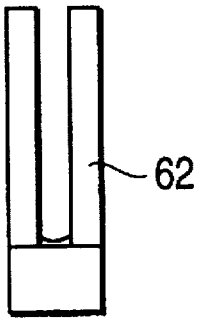
FIG. 17 is a front view of a test jack base of the test jack assembly shown in FIG. 15.
Figure 15:
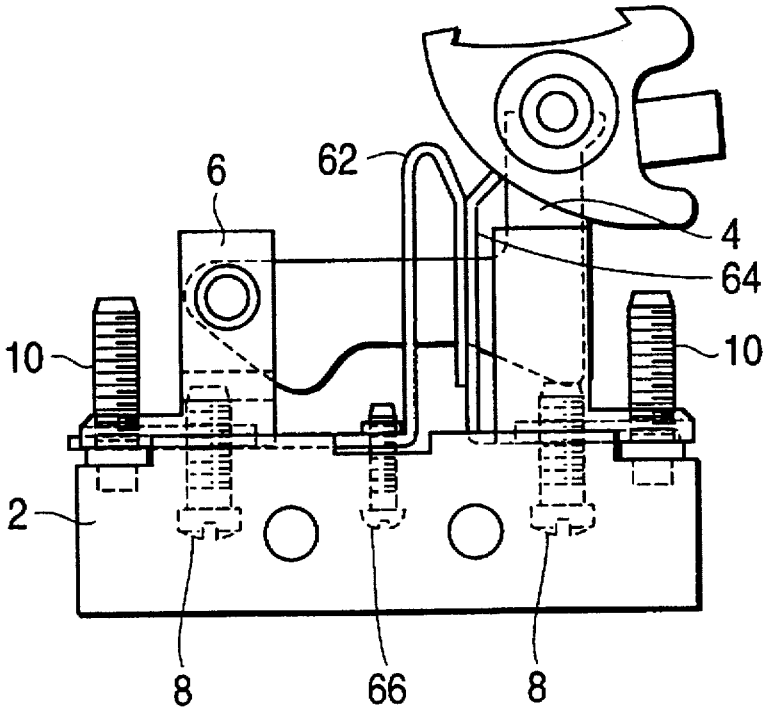
FIG. 15 is an exploded side view of a test jack assembly.

FIG. 15 is a partially exploded side view of a test jack 60 installation. The test jack 60 has a base part 62 which connects with the common bar (not shown in FIG. 15) and the rear conductor 6. The test jack 60 also has a fork part 64 which connects with the front conductor 4. The base part 62 is connected to the switch with a mounting screw 8, a connector screw 10 and an accessory screw 66, as shown. Similarly, the fork part 64 is connected to the switch with a mounting screw 8 and a connector screw 10. When installed, the base part 62 and the fork part 64 are in contact as shown by the bottom portion of FIG. 15. As shown in the front views of FIGS. 16 and 17, both the base part 62 and fork part 64 have slots in the middle thereof. This is so that the test jack 60 does not interfere with movement of switch piece 12.

As can be seen in FIG. 15, both the base part 62 and fork part 64 have an angled portion 68. The angled portions 68 allow the test jack 60 to receive a testing device element. With the shorting element 52 and test jack 60 installed side-by-side, an operator can shunt current from the first switch having the shorting element via a common bar 36. Without stopping the flow of current, current is transferred to the switch having a test jack 60 thereon, and the current continues to flow out of that switch. Then, in the switch having the test jack 60 thereon, tests can be performed by inserting a testing device between base part 62 and fork part 64, thereby the characteristics of the power travelling through the switches can be evaluated.

While the invention has been described in connection with the preferred embodiments, it will be understood that modifications thereof within the principles outlined above will be evident to those skilled in the art. Thus, the invention is not limited to the preferred embodiments, but is intended to encompass such modifications.

What is claimed is:

1. A power test switch operable by a holder tool, comprising:

a generally parallelepiped base having first and second opposing ends, and two holes extending therethrough, from a top to a bottom thereof, the two holes being located respectively at the first and second opposing ends of the base, the base having two sides which connect the top and bottom and which run from the first to the second opposing ends;

first and second electrical conductors mounted on the top of the base respectively with first and second mounting pieces extending respectively through the two holes in the base;

a switch piece for electrically connecting the first and second electrical conductors, the switch piece pivoting on the first conductor to connect with the second conductor when parallel to the top of the base and to disconnect from the second conductor when extending away from and at an angle to the base, the switch piece having an upper portion which extends away from the base when the switch piece is parallel to the base;

an insulated handle attached to the upper portion of the switch piece for manually pivoting the switch piece;

a projection attached to and extending away from the insulated handle, the projection extending parallel with, or at an angle less than 45° to the base when the switch piece is parallel to the base, the projection having a substantially constant cross-sectional shape extending away from the handle so that the projection can fit snugly within the holder tool; and an angled insulating plate fitting next to the base, the insulating plate having a first plate portion and a second plate portion generally perpendicular to the first plate portion such that the angled insulating plate fits adjacent to the bottom of the base to cover the two holes extending through the base and fits adjacent to only one of the two sides of the base which run from the first to the second opposing ends.

2. A power test switch according to claim 1, wherein when the first and second electrical conductors are connected with the switch piece, the power test switch can transfer power having a potential of at least 440 volts and a current of at least 20 amps.

3. A power test switch according to claim 1, further comprising:

first and second bolts extending from the base and electrically connected respectively with the first and second electrical conductors; and nuts for fitting on the first and second bolts extending from the base, the nuts having a diameter and a plurality of sides, wherein the diameter of the projection substantially corresponds with the diameter of the nuts.

4. A power test switch according to claim 1, wherein the insulated handle has upper and lower extensions on either side of the projection which define an indented surface portion therebetween from which the projection extends, the indented surface portion having a width corresponding to the width of a human finger, the switch piece pivoting in a plane of movement with the upper and lower extensions being located in the plane of movement.

5. A power test switch according to claim 1, wherein the mounting pieces are conductive mounting screws.

6. A power test switch according to claim 1, wherein the base has a third hole, between the first and second holes, extending through the base, from the top to the bottom thereof, the base having a decreased thickness in the vicinity of the third hole such that the top has a notch therein in the vicinity of the third hole.

7. A power test switch according to claim 6, wherein at least a portion of the second plate portion of the insulating plate has a height that is less than or equal to the decreased thickness of the base in the vicinity of the third hole.

8. A power test switch according to claim 1, wherein the base has two side holes extending from one of the two sides which run from the first to the second opposing ends to the other of the two sides, and wherein the second plate portion of the insulating plate has two holes extending therethrough which respectively communicate with the two side holes in the base when the insulated plate is fitted next to the base.

9. A power test switch according to claim 1, wherein the first and second electrical conductors extend away from the top of the base, within planes defined by the two sides of the base which run from the first to the second opposing ends of the base, and wherein the second plate portion of the insulating plate has a height which extends above the top of the base.

10. A power test switch operable by a holder, comprising:

a base having first and second opposing ends;

first and second electrical conductors mounted respectively on the first and second ends of the base;

a switch piece for electrically connecting the first and second electrical conductors, the switch piece pivoting on the first conductor to connect with the second conductor when parallel to the base and to disconnect from the second conductor when extending away from and at angle to the base, the switch piece having an upper portion which extends away from the base when the switch piece is parallel to the base;

an insulated handle attached to the upper portion of the switch piece for manually pivoting the switch piece; and a projection attached to and extending away from the insulated handle, the projection extending parallel with, or at an angle less than 45° to the base when the switch piece is parallel to the base, the projection having a substantially constant cross-sectional shape extending away from the handle so that the projection can fit snugly within the holder tool.

11. A power test switch according to claim 10, further comprising:

first and second bolts extending from the base and electrically connected respectively with the first and second electrical conductors;

nuts for fitting on the first and second bolts extending from the base, the nuts having a diameter and a plurality of sides, wherein the diameter of the projection substantially corresponds with the diameter of the nuts.

12. A power test switch according to claim 10, wherein the insulated handle has upper and lower extensions on either side of the projection which define an indented surface portion therebetween from which the projection extends, the indented surface portion having a width corresponding to the width of a human finger, the switch piece pivoting in a plane of movement with the upper and lower extensions being located in the plane of movement.

13. A power test switch, comprising:

a generally parallelepiped base having first and second opposing ends, and two holes extending therethrough, from a top to a bottom thereof, the two holes being located respectively at the first and second opposing ends of the base, the base having two sides which connect the top and bottom and which run from the first to the second opposing ends;

first and second electrical conductors mounted on the top of the base respectively with first and second mounting pieces extending respectively through the two holes in the base;

a switch piece for electrically connecting the first and second electrical conductors, the switch piece pivoting on the first conductor to connect with the second conductor when parallel to the top of the base and to disconnect from the second conductor when extending away from and at an angle to the base; and an angled insulating plate fitting next to the base, the angled insulating plate having a first plate portion and a second plate portion generally perpendicular to the first plate portion, such that the first plate portion fitting adjacent to the bottom of the base to cover the two holes extending through the base, the second plate portion fitting adjacent to one side of the base which runs from the first to the second opposing ends, the angled insulating plate having an open side opposite the second plate portion such that the other side of the base which runs from the first to the second opposing ends remains open.

14. A power test switch according to claim 13, wherein the mounting pieces are conductive mounting screws.

15. A power test switch according to claim 13, wherein the base has a third hole, between the first and second holes, extending through the base, from the top to the bottom thereof, the base having a decreased thickness in the vicinity of the third hole such that the top has a notch therein in the vicinity of the third hole.

16. A power test switch according to claim 15, wherein at least a portion of the second plate portion of the insulating plate has a height that is less than or equal to the decreased thickness of the base in the vicinity of the third hole.

17. A power test switch according to claim 13, wherein the base has two side holes extending from one of the two sides which run from the first to the second opposing ends to the other of the two sides, and wherein the second plate portion of the insulating plate has two holes extending therethrough which respectively communicate with the two side holes in the base when the insulated plate is fitted next to the base.

18. A power test switch according to claim 13, wherein the first and second electrical conductors extend away from the top of the base, within planes defined by the two sides of the base which run from the first to the second opposing ends of the base, and wherein the second plate portion of the insulating plate has a height which extends above the top of the base.

* * * * *

UNITED STATES PATENT AND TRADEMARK OFFICE

CERTIFICATE OF CORRECTION

PATENT NO. 5,722,534

DATED March 3, 1998

INVENTOR(S) Jere WRIGHT

It is certified that error appears in the above-identified patent and that said Letters Patent is hereby corrected as shown below:

Col. 8, line 17, after "portion", delete "such that".

Signed and Sealed this

Twenty-ninth Day of September, 1998

*Attest:*

*Attesting Officer*

Bruce Lehman

BRUCE LEHMAN

*Commissioner of Patents and Trademarks*